United States Patent [19]

Tarumi et al.

[11] 4,377,629

[45] Mar. 22, 1983

[54] LAYERED CHARGE CARRIER MEMBER AND METHOD OF FORMING IMAGE USING SAME

[75] Inventors: Noriyoshi Tarumi, Hachioji; Kiyoshi Kimura, Iruma; Haruo Iwahashi, Fussa, all of Japan

[73] Assignee: Konishiroku Photo Industry Co., Ltd., Tokyo, Japan

[21] Appl. No.: 244,338

[22] Filed: Mar. 17, 1981

[30] Foreign Application Priority Data

Mar. 31, 1980 [JP] Japan ..... 55-42469

[51] Int. Cl.[3] ..... G03G 5/08

[52] U.S. Cl. ..... 430/62; 430/63; 430/64; 430/65; 430/109; 430/106.6; 430/122; 430/904; 428/474.7

[58] Field of Search ..... 430/62, 63, 64, 65, 430/69; 428/474.4

[56] References Cited

U.S. PATENT DOCUMENTS 3,634,079 1/1972 Champ ..... 430/62

4,119,461 10/1978 Yamada et al. ..... 430/96 X

FOREIGN PATENT DOCUMENTS 1352487 5/1974 United Kingdom .

1496504 12/1977 United Kingdom .

*Primary Examiner*—John D. Welsh

*Attorney, Agent, or Firm*—Jordan B. Bierman; Linda Bierman

[57] ABSTRACT

A charge carrier member comprising an intermediate layer composed of a heat-resistant resin containing electrically conductive material, a charge carrier layer composed of a heat-resistant resin, and a support member. The support member is an electrically conductive support member or consists of an electrically conductive member which is provided on an insulating member. A method of forming a copy image which comprises a step for forming an electrostatic latent image on the charge carrier member, a step for converting the electrostatic latent image into a toner image using a developing agent, and a step for transferring the toner image onto a transfer medium.

28 Claims, 5 Drawing Figures

LAYERED CHARGE CARRIER MEMBER AND METHOD OF FORMING IMAGE USING SAME

BACKGROUND OF THE INVENTION

1. Field of the Invention

The present invention relates to a charge carrier member, and more specifically to a charge carrier member which can be repetitively used and which is adapted for the transfer-type electrostatic recording systems, and to a method of forming a copy image using the above charge carrier member.

2. Description of the Prior Art

A conventional transfer-type electrostatic recording system consists of forming an electrostatic latent image on the surface of the charge carrier layer of a charge carrier member by imparting an electric charge corresponding to the data such as characters, signs or figures by optical or charged ionic means, contacting a developing agent having a charge of the polarity opposite to that of the charge of the formed latent image to visualize the image, transferring the visualized image onto a transfer medium such as transfer paper by the electrostatic means or thermal means, and removing the residual toner and residual charge from the surface of the charge carrier layer after the image has been transferred.

Conventional charge carrier members used for the transfer-type electrostatic recording system can be represented by the lead oxide binder-type photosensitive member, selenium vaporized-type photosensitive member, and the like.

The electrostatic recording characteristics of these charge carrier members, however, are affected by the humidity. In particular, the recording characteristics are deteriorated in an atmosphere of high humidity conditions.

Further, the charge carrier members are subject to deterioration by heat. Or, photoconductive members such as zinc oxide, selenium and the like employed in the charge carrier members lose their potential characteristics or undergo the crystallization when they are heated. Therefore, use of the charge carrier members for the thermal transfer-type electrostatic recording system requires the provision of a large quenching unit, which causes the system to become bulky. Further, the provision of the quenching unit does not substantially help solve/the problem of weakness to heat.

There has been proposed a charge carrier member made of a heat-resistant resin such as fluorine-containing resin, polyamide resin or the like. However, although the charge carrier member employing the heat-resistant resin is satisfactory from the viewpoint of resistance against heat, the pattern developed between the charge carrier layer and the conductive support member tends to appear on the surface of the charge carrier layer, and is visualized as a toner image.

The picture obtained by using the charge carrier member which is made up of the heat-resistant resin presents a problem with regard to its quality. Moreover, the charge carrier member is electrically and locally deteriorated after it is repetitively irradiated with ions. Namely, the charge carrier member made up of the heat-resistant resin is not satisfactory with regard to durability.

Further, the problem still remains with regard to the adhesiveness to the electrically conductive support member. The charge carrier member often peels off of the support member when it is being used.

SUMMARY OF THE INVENTION

The object of the present invention is to provide a charge carrier member which is free of the above-mentioned defects, and to provide a method of forming a copy image using the charge carrier member.

The above-mentioned object of the present invention is accomplished by a method of forming a copy image which comprises the steps of forming an electrostatic latent image on a charge carrier member which is obtained by forming a charge carrier layer composed of a heat-resistant resin on an intermediate layer composed of a heat-resistant resin containing an electrically conductive material on a support member, converting the electrostatic latent image into a toner image, and transferring the toner image onto a transfer medium.

The charge carrier member (FIG. 1) of the present invention consists of an intermediate layer 2 composed of a heat-resistant resin containing an electrically conductive material, and a charge carrier layer 1 composed of a heat-resistant resin. The heat-resistant resin may be a fluorine-containing resin, a polyimide resin, a polyamide resin, a polyimideamide resin, a polyaryl sulfone resin, a polyphenylene sulfite resin, a thermosetting acrylic resin, a thermosetting alkyd resin, an epoxy resin, or mixtures thereof, which are widely used as heat-resistant resins in this field of the art.

Specific examples of the heat-resistant resin will be mentioned below. Examples of the fluorine-containing resin include polyethylene tetrafluoride, ethylene tetrafluoride/propylene hexafluoride copolymer, poly(trifluorochloroethylene), polyvinylidene fluoride, trifluorochloroethylene/vinylidene fluoride copolymer, polyperfluoroalkylene (PFA), polyvinyl-heptafluorobutylate, Amilan (nylon 6), Zytel (nylon 66), Capton (polyimide resin), Ryton PPSV-1 [polyphenylene sulfite resin, a product of Hodogaya Kagaku Co.], Astrel 360 [polyaryl sulfone resin, a product of 3 M Co.].

Among the above-mentioned heat-resistant resins, the fluorine-containing resin, polyimide resin, polyamide resin, polyimideamide resin, polyphenylene sulfite resin, or a mixture thereof, is preferably used in the present invention.

When the electrostatic latent image is to be formed by an ordinary electrophotographic method, or when the electrostatic latent image is to be formed by electric means, the charge carrier member of the present invention may contain a photoconductive material so that the electrostatic latent image can be easily extinguished after the image has been transferred.

Examples of the photoconductive material used for the present invention include inorganic materials as well as organic materials. Inorganic photoconductive materials will be CdS, CdSSe, CdSe, ZnSe, ZnCdS, $TiO_2$, ZnO and $CdS.CdCO_3$. The surfaces of these inorganic photoconductive materials may further be covered with a thermosetting resin.

Examples of the organic photoconductive material include pyrazoline-type material, oxadiazole-type material, and the like, which produce electric charge.

From the standpoint of resistance against the heat according to the present invention, it is desirable to use an inorganic photoconductive material.

The photoconductive material contained in the charge carrier layer 1 according to the present invention may be compatible with the heat-resistant resin which is specified by the present invention. The photoconductive material, however, may be dispersed in the form of a fine powder in the heat-resistant resin. The average diameter of the dispersed photoconductive material should be smaller than 5 microns, and should more desirably be smaller than 2 microns.

In order to control the surface potential, to increase resistance against the heat and to increase resistance against abrasion, the charge carrier layer 1 of the present invention may be blended with an inorganic pigment having high resistance, such as lead oxide, titanium oxide, calcium carbonate, silicic acid, silicate, zinc sulfide, magnesium oxide, aluminum oxide, mica, clay, talc, sericite, barium sulfate, or calcium carbonate, or a strong dielectric material such as barium titanate, lead titanate, magnesium titanate or the like.

Since the charge carrier member of the present invention is designed to be repetitively used, the surface should be smoothly polished so that the picture quality is improved, durability is increased, cleaning property is improved and contamination by the toner is prevented. Thus, with the surface being polished and smoothed, it is possible to clean the residual toner by a small and easily constructed blade maintaining high cleaning efficiency. The surface can be ground by using a grindstone, sand-paper, feather cloth, or by a combination thereof. The coarseness of the thus polished surface of the charge carrier member should be 5 microns or smaller.

As required, furthermore, the thus formed charge carrier layer 1 of the present invention may be admixed with widely known additives to improve the characteristics of the charge carrier layer.

The charge carrier layer of the present invention will be used over a wide range of film thickness, and preferably from 5 to 200 microns.

The charge carrier member of the present invention has an intermediate layer 2 which is formed between the charge carrier layer 1 and a support member 3.

The charge carrier member often invites the occurrence of patterns caused by mechanical patterns or by the adhesion of foreign matter on the surface of the electrically conductive support member. The patterns often float on the surface of the charge carrier layer and are visualized as a toner image. Further, through the repetitive irradiation of ions, the charge carrier layer of the charge carrier member is subject to be locally and electrically deteriorated. The intermediate layer 2 of the present invention, however, is quite effective to prevent the charge carrier layer from being deteriorated.

In addition to the above-mentioned effect, the intermediate layer 2 of the present invention works to improve the picture quality of the charge carrier member and to improve adhesiveness between the charge carrier layer and the support member.

Like the charge carrier layer, the intermediate layer 2 according to the present invention is composed of a heat-resistant resin which may be the same as, or different from, the heat-resistant resin employed for the charge carrier layer.

The intermediate layer 2 according to the present invention may contain an electrically conductive material to control the picture quality. Any electrically conductive material may be used. Widely used examples include pigments such as carbon black, Nigrosine pigment, Aniline Blue, Calco Oil Blue, metals or metal compounds such as stannic oxide, silver, copper, aluminum or titanium oxide. The smaller the particle diameter, the more effective it is for the present invention. Preferably, the particle diameter should be smaller than 2 microns, and more preferably, the particle diameter should be from 2 microns to 1 millimicron. Further, the intermediate layer should have a resistivity of $10^3$ to $10^{12}$ ohms·cm, and more preferably $10^5$ to $10^9$ ohms·cm.

The above-mentioned intermediate layer 2 of the present invention may further be blended, as required, with widely known additives to improve the properties of the intermediate layer.

The intermediate layer 2 of the present invention is used over a wide range of film thickness, and preferably from 0.5 to 100 microns.

The support member 3 according to the present invention is, usually, electrically conductive. The electrically conductive support member is formed by a metal sheet such as aluminum and stainless steel or by vaporizing an electrically conductive layer 4 composed of a metal, metal oxide or metal halide such as palladium, aluminum, platinum, indium oxide or cuprous iodide, on an insulating support member 5 composed of a polyimide film, polyethylene terephthalate film, polycarbonate film or polyethylene film. The support member 3, however, need not be limited to the above-mentioned examples only.

The support member 3 according to the present invention should be an aluminum sheet or an insulating support member 5 on which the aluminum layer 4 is deposited by evaporation.

Furthermore, the adhesiveness between the intermediate layer 2 and the electrically conductive support member of the present invention can be increased if the aluminum surface is treated by an anodic oxidation treatment which is widely performed, for example, by the almite treatment such as oxalic acid method, sulfuric acid method, or chromic acid method, or by the boehmite treatment. According to the charge carrier member of the present invention, the charge carrier layer 1 is formed on the intermediate layer 2 which is formed on the support member 3. In this case, a second intermediate layer may be formed between the conductive support member and the intermediate layer or between the intermediate layer and the charge carrier layer, or a protection layer may be formed on the charge carrier layer.

Below is mentioned a representative method of making the charge carrier member according to the present invention.

Among the heat-resistant resins, a resin which is insoluble in solvent, such as fluorine-containing resin, will be suspended in a water-type medium to prepare an emulsion. When the emulsion is to be used for forming the intermediate layer, an electrically conductive material is added. When the emulsion is to be used for forming the charge carrier layer, a photoconductive material is added. The resulting emulsion solution is then sprayed onto the conductive support member by means of spray or the like, followed by heating at about 350° C. to 400° C., thereby to form the intermediate layer 2 or the charge carrier layer 1 as contemplated by the present invention.

Further, the fluorine-containing resin has been placed in the market in the form of an emulsion in which it is suspended in a water-type medium, and this emulsion may be employed for the present invention. This emulsion is available in the market under the names of EK-4183GB, EK-4109BK, ND-4X and ND-2 [products produced by Daikin Kogyo Co.].

Further, a resin such as polyimide resin or polyimideamide resin which dissolves in a solvent, is dissolved in an organic solvent such as dimethyl acetamide or methyl pyrrolidone. When the thus obtained solution is to be used for forming the intermediate layer, an electrically conductive material is dispersed therein. When the solution is to be used for forming the charge carrier layer, on the other hand, a photoconductive material is dispersed. The resulting dispersion is applied onto the electrically conductive support member.

In the case of the polyimide resin, a polyamide acid which is an intermediate product thereof is dissolved in an organic polar solvent such as dimethyl acetamide. When this solution is to be used for forming the intermediate layer, an electrically conductive material is dispersed. When the solution is to be used for forming the charge carrier layer, on the other hand, a photoconductive material is dispersed. The resulting dispersion is then applied onto an electrically conductive support member, and is dehydrated by heating or by using a dehydrating agent, so that the solution is polyimidized.

With reference to the polyamide resin, a resin synthesized by the dehydration-condensation of a dimeric acid such as linolic acid or adipic acid with polyamine such as diethylene triamine or hexamethylene diamine, is dissolved in a hydrocarbon-type organic solvent such as cresol. When the resulting solution is to be used for forming the intermediate layer, an inorganic pigment or a photoconductive material is added. When the solution is to be used for forming the charge carrier layer, an electrically conductive material is added. The solution is then applied onto the electrically conductive support member.

With regard to the polyphenylene sulfite resin, Ryton PPSV-1 will be blended with an inorganic pigment or a photoconductive material when it is to be used for forming the intermediate layer. Alternatively, the Ryton PPSV-1 will be blended with an electrically conductive material when it is to be used for forming the charge carrier layer. The thus obtained solution or dispersion is then sprayed onto the electrically conductive support member and is baked at 370° C. for 1 hour to form the charge carrier member. In addition to using the above-mentioned water-type dispersions, it is also possible to electrostatically apply a powder followed by baking in the same manner as above.

In the case of the polyaryl sulfone resin, for example, the Astrol 360 is dissolved in the dimethyl formamide to prepare a solution. The solution is blended with an inorganic pigment or a photoconductive material when it is to be used for forming the intermediate layer. Alternatively, the solution is blended with a conductive material when it so to be used for forming the charge carrier layer. The solution is then applied onto the electrically conductive support member.

As mentioned above, the charge carrier member according to the present invention consists of an intermediate layer made up of a heat-resistant resin containing an electrically conductive material and a charge carrier layer made up of a heat-resistant resin, and exhibits excellent effects as will become obvious from working examples that will be mentioned later.

In addition to the above-mentioned effects, the charge carrier member of the present invention makes it possible to obtain a copy image by using any other transfer systems (such as pressurized transfer system, thermal transfer system, sticky transfer system) which do not destroy the electrostatic latent image during the transferring step like the electrostatic transfer system. Accordingly, the charge carrier member of the present invention enables the retention process to be carried out, copying operation to be effected at high speeds, and makes it possible to provide a small, inexpensive, and high-performance copying apparatus.

The charge carrier member of the present invention is stretched on a charge carrier drum or on a charge carrier belt, uniformly charged on the surface thereof by an electric charger, and is exposed to the light to form an electrostatic latent image. Alternatively, the surface of the charge carrier member is charged by electric means such as a needle electrode or the like to form an electrostatic latent image. The thus formed electrostatic latent image is then developed by such a developing method as the cascade method, impression method, hair brush method or magnetic brush method, and is converted into a toner image. The developing can be effected by using any developing agent which is used for ordinary electrophotographic process. The developing agent can be grouped into a two-component developing agent consisting of toner and carrier, and a one-component developing agent consisting of toner only.

The charge carrier member carrying the toner image transfers the toner image onto a transfer medium through a transfer portion. The transfer medium may be a transfer paper. In this case, the toner image is transferred onto the transfer paper by the thermal transfer or pressurized transfer. Thereafter, the toner image is fixed under the application of heat or pressure, and is turned into a permanent image. The image, however, may be fixed by the above-mentioned means simultaneously with the transfer of the image.

Further examples of the transfer medium may be a tacky transfer medium such as a tacky transfer belt or a tacky transfer roller. The tacky transfer medium receives the toner image from the charge carrier member of the present invention upon the application of pressure or the like, and then transfers the toner image onto, for example, a transfer paper by the above-mentioned means. Even in this case, the toner image which is just transferred onto the transfer paper may be fixed to form a permanent image. The transfer paper carrying the toner image as permanent image is discharged from the system. The tacky transfer medium which has transferred the toner image onto the transfer paper will be repetitively used. Here, there will be no need to clean the tacky transfer medium since it features high transfer efficiency (80% or more). To prevent the transfer medium from being contaminated through the use of long periods of time, however, it may be cleaned by using a cleaning blade or the like.

After the toner image has been transferred, the charge carrier member is discharged by a discharger, cleaned by a cleaning blade or a hair brush, and is used repetitively.

Other objects and features of the present invention will become obvious from the following description taken in conjunction with the accompanying drawings.

DESCRIPTION OF THE PREFERRED EMBODIMENTS

Figure 1:
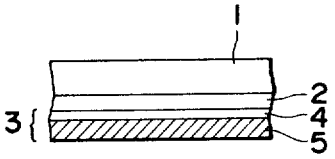
FIG. 1 is a diagram illustrating the setup of layers in the charge carrier member according to the present invention.
Figure 2:
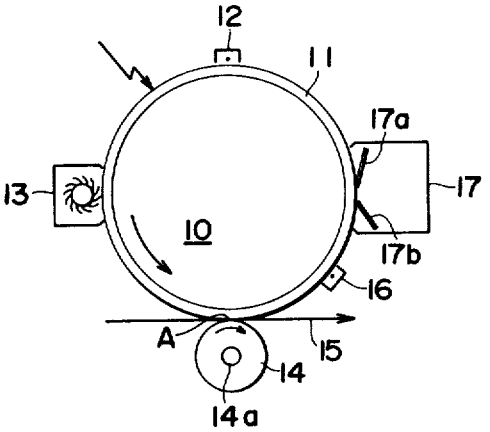
FIG. 2 is a diagram illustrating an embodiment of a copying apparatus which is used for realizing the method of forming copy image according to the present invention.

FIG. 2 illustrates a copying machine according to the present invention, which directly transfers the toner image from the charge carrier member to a transfer paper and fixes it.

Reference numeral 10 denotes a charge carrier drum, and 11 denotes a charge carrier member of the present invention which is stretched along the charge carrier drum 10.

Reference numeral 13 denotes a developing device for developing an electrostatic latent image that is formed on the charge carrier member 11.

Reference numeral 14 denotes a fixing roller for transferring and fixing the image onto the transfer paper at a transfer portion A, and 14*a* denotes a heating source for heating the fixing roller 14 from the inner side.

Reference numeral 15 denotes a transfer paper, 16 denotes a discharger for erasing the residual charge on the charge carrier member 11 after the toner image has been transferred onto the transfer paper, and 17 denotes a cleaning device for cleaning the residual toner on the charge carrier member 11, wherein 17*a* denotes a cleaning blade for scraping the residual toner on the charge carrier member 11, and 17*b* denotes a toner guide plate for guiding the scraped toner into the cleaning device.

The operation of the device of FIG. 2 is illustrated below. The charge carrier drum 10 on which the surface is stretched the charge carrier member 11 of the present invention, is rotated in the direction of arrow by a drive source (not shown).

The surface of the charge carrier member 11 is uniformly charged by a charger 12, and is then exposed to the light (indicated by arrow at the upper left portion in FIG. 2) to form electrostatic latent image. The thus formed electrostatic latent image is developed by the developing device 13 and is converted into a toner image. The toner image then reaches the transfer portion A where the toner image on the charge carrier member 11 is transferred and is fixed onto the transfer paper 15 that is fed by a separate feeding means (not shown) being pressed by the heating roller 14 from the back side of the transfer paper. The heating roller 14 turns in the direction of the arrow and contains the heating source 14*a*. Thus, the toner image which is a permanent image is obtained on the transfer paper 15, and the transfer paper 15 bearing the toner image is exhausted from the system. After the image has been transferred, the residual charge is erased from the surface of the charge carrier member 11 by the discharger 16, the residual toner is scraped off by the cleaning blade 17*a* in the cleaning device 17, and the scraped off toner is recovered in the cleaning device being guided by the toner guide plate 17*b*.

The charge carrier drum 10 further continues to rotate, and is used repetitively.

Using the apparatus of FIG. 2, it is possible to perform the retention process (exposure is not effected) after the image has been transferred by setting the developing step and the transfer portion only to be operative, and setting the discharger 16 and the charger 12 to be inoperative, with the cleaning blade 17*a* and the toner guide plate 17*b* in the cleaning device 17 being separated away from the surface of the charge carrier member 11.

The charge carrier member of the present invention is not thermally deteriorated even when the charge carrier drum is brought into direct contact with the heating/fixing roller as in the copying apparatus of FIG. 2, and the charge carrier member of the present invention maintains a high performance over extended periods of time.

Figure 3:
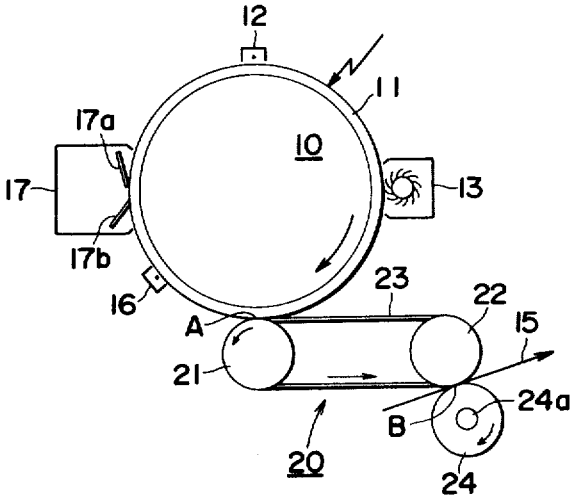
FIG. 3 is a diagram illustrating another embodiment of the copying apparatus which is used for the method of forming a copy image according to the present invention.

FIG. 3 illustrates a copying apparatus according to another embodiment of the present invention, in which a tacky transfer belt is used at the transfer portion.

Reference numerals 10 to 17 denote the same members as those of FIG. 2, and are not illustrated.

Reference numeral 20 denotes a tacky transfer portion which transfers the toner image on the charge carrier member onto the tacky transfer belt and then transfers the toner image onto the transfer paper. Reference numeral 21 denotes a transfer roller which is in pressed contact with the charge carrier member 11, and 22 denotes a pressing roller. A tacky transfer belt composed of a silicone rubber of the type which hardens at ordinary temperature, runs between these two rollers. Reference numeral 24 denotes a fixing roller accommodating a heating source 24*a*.

In the apparatus of FIG. 3, the toner image carried by the charge carrier member 11 is transferred at the transfer portion A onto the tacky transfer belt 23 that runs between the transfer roller 21 and the pressing roller 22. The tacky transfer belt 23 onto which is transferred the toner image moves in the direction of the arrow. The toner image is then transferred and fixed at the fixing portion B onto the transfer paper 15 that is fed by feeding means (not shown) being pressed, from the back side of the transfer paper 15, by the heating roller 24 which rotates in the direction of the arrow and which contains the heating source 24*a*. The transfer paper 15 carrying the toner image which is a permanent image, is then exhausted from the system.

After the toner image is transferred onto the tacky transfer belt, the charge carrier member 11 is repetitively used passing through the discharger 16 and the cleaning device 17 like the apparatus shown in FIG. 2.

Like the apparatus of FIG. 2, the retention process can be performed by using the apparatus of FIG. 3 by setting the discharger 16 and the cleaning device 17 to be inoperative.

After the toner image is transferred onto the transfer paper 15, the tacky transfer belt 23 is repetitively used. After the toner image has been transferred, however, the tacky transfer belt 23 may be cleaned by cleaning means such as a cleaning roller or cleaning blade.

Figure 4:
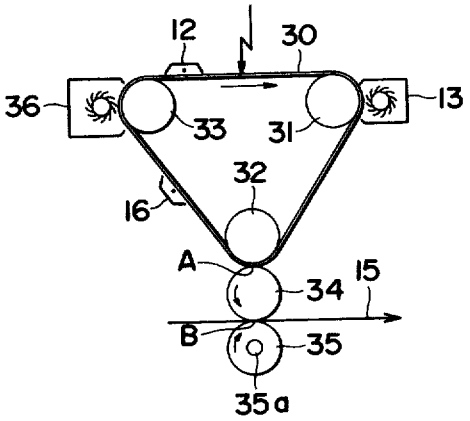
FIG. 4 illustrates an embodiment in which the charge carrier member is held in the form of an endless belt in the copying apparatus which is used for the method of forming a copy image according to the present invention.

FIG. 4 shows a copying apparatus according to a further embodiment of the present invention, in which a charge carrier belt is used instead of the charge carrier drum.

Reference numerals 12, 13, 15 and 16 denote the same members as those of FIG. 2, and are not mentioned here. Reference numeral 30 denotes a charge carrier belt along which is stretched the charge carrier member of the present invention, 31 denotes a drive roller which is driven by a drive source that is not diagrammatized, 32 denotes a pressing roller, and 33 denotes a driven roller. The charge carrier belt runs about the rollers 31, 32 and 33 in the direction of the arrow in such a manner that the charge carrier member is disposed on the outer side. Reference numeral 34 denotes a transfer roller for transferring the toner image, and 35 denotes a fixing roller accommodating a heating source 35*a*.

The charge carrier belt 30 of which the surface is uniformly charged by the charger 12 runs in the direction of the arrow, and is exposed at a position of the arrow at the central upper portion of FIG. 4 to form electrostatic latent image. The thus formed electrostatic latent image is developed by the developing device 13 and is converted into the toner image. The charge carrier belt 30 carrying the toner image is compressed at the transfer portion A between the pressing roller 32 and the transfer roller 34, whereby the toner image is transferred onto the transfer roller 34.

After the toner image has been transferred, the residual charge is erased from the charge carrier belt 30 by the discharger 16, and the residual toner is removed by the cleaning device 36. The charge carrier belt 30 is used repetitively.

The transfer roller 34 to which the toner image is transferred, on the other hand, runs in the direction of the arrow and reaches the fixing portion B where it is brought into pressed contact with the transfer paper 15 that is fed by feeding means which is not shown being pressed, from the back side of the transfer paper 15, by the fixing roller 35 which runs in the direction of arrow and which contains the heating source 35*a*. The toner image is then permanently fixed by heat. The transfer paper carrying the toner image as the permanent image is then exhausted from the system.

Like the apparatus of FIGS. 2 and 3, the retention process can also be effected by using the apparatus of FIG. 4. Using the apparatus of FIGS. 2 to 4, the electrostatic latent image can be formed on the charge carrier member by electric means such as a needle electrode while setting the charger 12 to be inoperative, instead of effecting the optical exposure.

Below are mentioned in detail developing agents that can be used for the method of forming a copy image in accordance with the present invention.

It is desired that the developing agent be blended with a parting agent. The developing agent blended with the parting agent is particularly desirable when it is used for the thermal transfer system or pressure transfer system other than the electrostatic transfer system. The method of endowing the developing agent with the parting agent can be broadly classified into two methods. Namely, a method which imparts the parting agent (or often called offset-preventing agent) to the toner which is being developed, and a method which adds the parting agent to the developing agent and uses the thus obtained mixture. In the case of the electrostatic recording apparatus employing a thermal roller fixing device, the parting agent so works that the non-fixed toner on the transfer paper is prevented from adhering to the hot roller when it passes through the hot roller, in order to prevent the phenomenon (offset phenomenon) by which the toner is stabilized to other places on the transfer paper. According to the present invention, the toner on the surface of the charge carrier member (or on the surface of the tacky transfer belt or the like) adheres to the entire surface of the transfer paper (or tacky transfer belt or the like) and is not left on the surface of the charge carrier member (or the surface of the tacky transfer belt or the like), or the once transferred toner is not adhered again to the surface of the charge carrier member (or the surface of the tacky transfer belt or the like), or the toner is not adhered to other locations of the transfer paper (or tacky transfer belt or the like) or to other transfer papers (or tacky transfer belt or the like).

The parting agent may consist of a toner-binding resin provided with a parting property, or the toner-binding resin admixed with an additive that serves as a parting agent.

Examples of the toner-binding resin having parting property include a polymer of a styrene-type monomer, a polymer of a vinyl-type monomer, a copolymer of a styrene-type monomer and a vinyl-type monomer.

Examples of the styrene-type monomer include styrenes and derivatives thereof such as styrene, m-methyl styrene, p-methyl styrene, p-ethyl styrene, 2,4-dimethyl styrene, p-tert-butyl styrene, p-n-hexyl styrene, p-methoxy styrene, p-phenyl styrene, 3,4-dichlorostyrene, and the like. Among them, a styrene monomer is most desirable. Examples of the other vinyl-type monomer include ethylenically unsaturated monoolefins such as ethylene, propylene, butylene, isobutylene and the like; vinyl halides such as vinyl chloride and vinylidene chloride; vinyl esters such as vinyl acetate, vinyl benzoate, and vinyl butylate; α-methylene aliphatic monocarboxylic acid esters such as methyl acrylate, ethyl acrylate, isobutyl acrylate, dodecyl acrylate, 2-ethylhexyl acrylate, 2-chloroethyl acrylate, phenyl acrylate, α-methyl chloroacrylate, methyl methacrylate, ethyl methacrylate, isobutyl methacrylate, 2-ethyl hexyl methacrylate, stearyl methacrylate, phenyl methacrylate, dimethylaminoethyl methacrylate, and diethylaminoethyl methacrylate; derivatives of acrylic acid or methacrylic acid such as acrylonitrile and acrylamide; vinyl ethers such as vinyl ethyl ethers; vinyl ketones such as vinyl methyl ketones; N-vinyl compounds such as N-vinyl pyrrole, and N-vinyl carbazole; and vinyl naphthalenes.

Specific examples of the copolymer include styrene/vinyl acetate copolymer, styrene/methyl methacrylate copolymer, styrene/methyl acrylate copolymer, styrene/2-ethylhexyl methacrylate copolymer, styrene/2-chloroethyl acrylate copolymer and styrene/phenyl methacrylate copolymer. These polymers should have a weight average molecular weight of greater than 3,000, and preferably a weight average molecular weight of from 3,000 to 500,000.

Furthermore, these polymers should have a ratio of weight average molecular weight to number average molecular weight of greater than 3.5.

Examples of the parting agent in the form of an additive will include a low molecular weight olefin polymer, a metal salt of fatty acid, a higher fatty acid, fatty acid amide, a higher alcohol, a hydrocarbon-type lubricating agent, and fatty acid ester.

The low molecular weight olefin polymer used for the developing agent of the present invention may be an olefin polymer which contains olefins only as monomeric components or an olefin copolymer which contains monomers other than olefin as monomeric components, and has a low molecular weight. Examples of the olefins as monomeric components include ethylene, propylene, butene-1, octene-1, or homologs thereof having unsaturated bond at different positions, or 3-methyl-1-butene or 3-propyl-5-methyl-2-hexane having alkyl group as a branched chain.

Further, examples of the monomers, other than the olefins, which serve as monomer components for forming a copolymer together with olefin, include vinyl ethers such as vinylmethyl ether, and vinylphenyl ether; vinyl esters such as vinyl acetate and the like; haloolefins such as tetrafluoroethylene, vinyl chloride, vinylidene chloride and tetrachloroethylene; acrylic acid esters or methacrylic acid esters such as methyl acrylate; ethyl acrylate, methyl methacrylate, ethyl methacrylate, n-butyl methacrylate, stearyl methacrylate, N,N-dimethylaminoethyl methacrylate, t-butylaminoethyl methacrylate; acrylic derivatives such as acrylonitrile and N,N-dimethylacrylamide; organic acids such as acrylic acid, methacrylic acid and the like; and diethyl fumarate, β-pinene, and the like.

Examples of the low molecular weight olefin polymer according to the present invention will be olefin polymers composed of olefins only containing at least two or more olefins that are mentioned above a monomer components, such as ethylene/propylene copolymer, ethylene/butene copolymer, ethylene/pentene copolymer, propylene/butene copolymer, propylene/-pentene copolymer, ethylene/3-methyl-1-butene copolymer and ethylene/propylene/butene copolymer, or olefin copolymers containing at least one of the above-mentioned olefins and at least one of the above-mentioned monomers other than olefin as monomer components, such as ethylene/vinyl acetate copolymer, ethylene/vinylmethyl ether copolymer, ethylene/vinyl chloride copolymer, ethylene/methyl acrylate copolymer, ethylene/methyl methacrylate copolymer, ethylene/acrylic acid copolymer, propylene/vinyl acetate copolymer, propylene/vinylethyl ether copolymer, propylene/ethyl acrylate copolymer, propylene/methacrylic acid copolymer, butene/methyl methacrylate copolymer, pentene/vinyl acetate copolymer, hexene/-vinyl butylate copolymer, ethylene/propylene/vinyl acetate copolymer, ethylene/vinyl acetate/vinylmethyl ether copolymer, and the like.

Among the low molecular weight olefin polymers according to the present invention, those containing monomers other than olefins as monomer components, should contain olefin components in amounts as large as possible. This is because the parting property diminishes and the flowability of toner and picture quality are deteriorated with the decrease in the content of olefin components. Therefore, the copolymers should contain olefin components in amounts as large as possible. According to the present invention, the copolymer containing more than about 50 mole % of olefin components is effectively used.

The molecular weight of the low molecular weight olefin polymer according to the present invention should be encompassed in a concept of low molecular weight which is usually accepted in the field of high molecular compounds, and should generally range from 1,000 to 45,000, and preferably from 2,000 to 6,000 in terms of weight average molecular weight.

The low molecular weight olefin polymer according to the present invention should have a softening point of 100° to 180° C., and particularly 130° to 160° C.

The low molecular weight olefin polymer according to the present invention is used in an amount of 1 to 20 parts by weight per 100 parts by weight of the resin component of toner, and preferably in an amount of 3 to 15 parts by weight. With the amount being smaller than 1 part by weight, parting property is not sufficiently exhibited. With the amount being greater than 20 parts by weight, on the other hand, other properties of the toner are deteriorated.

Further examples of the parting agent used for the developing agent of the present invention may be metal salts of fatty acid, such as lead, zinc, magnesium, cobalt, copper, calcium, cadmium, iron, nickel, aluminum or barium of lauric acid, myristic acid, palmitic acid, stearic acid, arachic acid, behenic acid, oleic acid, capric acid, caproic acid, linoleic acid, ricinoleic acid, or ricinolenic acid.

Examples of higher fatty acids include decanoic acid, lauric acid, myristic acid, palmitic acid, stearic acid, oleic acid, linoleic acid and ricinoleic acid having 8 or more carbon atoms.

Examples of the fatty acid amide include lauric acid amide, myristic acid amide, palmitic acid amide, stearic acid amide, arachic acid amide, behenic acid amide, oleic acid amide, linoleic acid amide, linolenic acid amide, gadoleic acid amide, erucic acid amide and selacholeic acid.

Examples of the bisfatty acid amide include bislauric acid amide, bismyristic acid amide, bispalmitic acid amide, bisstearic acid amide, and N,N'-didodecanoylethylene diamine.

Examples of the higher alcohol include lauryl alcohol, myristyl alcohol, cetyl alcohol, stearyl alcohol, behenyl alcohol and oleyl alcohol.

Examples of the fatty acid ester include esters of fatty acid and monovalent alcohol, and whole esters or partial esters of fatty acid and polyhydric alcohol.

Examples of the hydrocarbon-type lubricating agent include natural paraffin, synthetic paraffin, microwax and chlorinated paraffin. These parting agents are used in an amount of 0.1 to 65% by weight, and preferably in an amount of 0.2 to 20% by weight with respect to the developing agent.

Although the foregoing description has dealt with concrete examples of the parting agent that can be used for the developing agent of the present invention, it should be noted that the parting agents employed in the present invention are not necessarily restricted to the above examples only. These parting agents and methods of synthesizing them have been taught, for example, in U.S. Pat. No. 4,164,476, British Pat. No. 1,447,835 and British Pat. No. 1,495,428.

Below are mentioned additives which are added to the developing agents used in the present invention, and a method of preparing them.

The toner according to the present invention contains a resin for binding toner in addition to the afore-mentioned parting agents. The resin may possess a parting property as mentioned above, or may be an epoxy resin, a polyester resin or a polyamide resin without a parting property.

The toner according to the present invention may be blended with any coloring agent such as a pigment or dyestuff, as required. Any widely known coloring agents may be used such as carbon black, Nigrosine dyestuff, Aniline Blue, Calco Oil Blue, Chrome Yellow, Ultramarine Blue, Du Pont Oil Red, Quinoline Yellow, Methylene Blue chloride, Phthalocyanine Blue, Malachite Green oxalate, lamp black, oil black, azo-oil black, Rose Bengale, and mixtures thereof. When it is desired to obtain zerographic copies of the printed characters, the toner may be prepared from a black dye such as carbon black or Amaplasto black.

The coloring agent can be added to the toner of the present invention in widely varying amounts and, usually, from 1 to 20 parts by weight with respect to 100 parts by weight of the resin for binding the toner.

When the toner according to the present invention is to be used as a one-component-type developing agent, any magnetic material can be added.

The magnetic material to be used in the present invention should be strongly magnetized in the direction of the magnetic field. Preferably, the magnetic material should be black in color, should disperse well in the resin, should be chemically stable, and should have a particle size of as fine as 1 micron or smaller. The most preferred example will be the magnetite (tri-iron tetroxide). Representative examples of the magnetic or magnetizable material are metals such as cobalt, iron and nickel; alloys and mixtures of metals such as aluminum, cobalt, copper, iron, lead, magnesium, nickel, tin, zinc, antimony, beryllium, bismuth, cadmium, calcium, manganese, selenium, titanium, tungsten and vanadium; metal compounds containing metal oxides such as aluminum oxide, iron oxide, copper oxide, nickel oxide, zinc oxide, titanium oxide and magnesium oxide; refractory titanates such as vanadium titanate and chromium titanate; carbides such as tungsten carbide and silica carbide; ferrite and mixtures thereof. These ferromagnetic materials should have an average particle size of 0.1 to 1 micron, and should be contained in the toner in an amount of preferably from about 50 to 300 parts by weight per 100 parts by weight of the resin component for binding the toner. Particularly preferred is an amount of from 90 to 200 parts by weight per 100 parts of the resin component.

The toner according to the present invention may further be blended with a charge controlling agent, fluidizing agent, and the like.

The toner according to the present invention can be prepared by any method such as a so-called milling method, polymerization method, or the like.

The milling method consists of mixing, for example, a resin for binding the toner, a parting agent, a coloring agent, a charge controlling agent and a magnetic material, followed by melting and kneading, cooling, and pulverizing.

On the other hand, the polymerization method consists of mixing a parting agent, a coloring agent, a charge controlling agent, and a magnetic material to a monomer of resin for binding the toner, thereby to prepare the toner by, for example, the suspension polymerization.

The average particle size of the toner of the present invention ranges from 1 to 50 microns, and preferably from 7 to 30 microns. With the average particle diameter of the toner being in excess of 50 microns, the picture quality is greatly coarsened and makes it difficult to form a practical picture. With the average particle diameter being smaller than 1 micron, on the other hand, the surface of the charge carrier member is contaminated (a so-called toner filming phenomenon develops), the sensitivity of the charge carrier member is decreased, and the picture quality is deteriorated. The toner of the present invention should have a softening point of 100° to 170° C. as measured by the ring and ball method, and a glass transition point of 40° to 110° C. Namely, when the softening point is smaller than 100° C., the toner develops the phenomenon of toner filming when it is pulverized, and causes the charge carrier member to be contaminated. When the softening point is higher than 170° C., on the other hand, the toner is so hard that it cannot be easily pulverized. Furthermore, the toner necessitates large amounts of heat when it is to be fixed, and makes the fixing efficiency poor. On the other hand, when the glass transition point is lower than 40° C., the toner tends to agglomerate due to a so-called cold-flow phenomenon since the toner is usually preserved at a temperature of lower than 40° C. When the glass transition point is higher than 110° C., the fixing operation must be effected to an elevated temperature which adversely affects the charge carrier member, the tacky transfer belt and the like.

EXAMPLE 1

A liquid for forming the intermediate layer was prepared by blending a heat-resistant resin for forming the intermediate layer, electrically conductive carbon black HS-500 [a product of Asahi Carbon Co.], and aluminum powder or $SnO_2$ which are shown in Table 1 at ratios shown in Table 1, and by adding 20 parts by weight of a solvent, followed by stirring in a ball mill for more than 24 hours.

The liquid for forming the intermediate layer was then applied onto the surface of an aluminum drum (material A-5056BD) of an outer diameter of 120 mm and a thickness of 5 mm, of which the surface has been sufficiently polished by diamond cutting tool and dewaxed with trichlene, such that the thickness of the film was as shown in Table 1, in accordance with the method that was mentioned in the foregoing.

Heat-resistant resins shown in Table 1 were applied onto the intermediate layer by the method mentioned in the foregoing to form a charge carrier layer, in order to prepare specimens A to P of the charge carrier members as contemplated by the present invention.

TABLE 1

| | Charge carrier layer | | | Intermediate layer | | |
|---|---|---|---|---|---|---|
| Specimen | Heat-resistant resin | Photoconductive material | Film thickness (μ) | Heat-resistant resin | Photoconductive material | Film thickness (μ) |
| A | polyethylene tetrafluoride | — | 100 | polyethylene tetrafluoride | carbon black | 10 |
| B | polyethylene tetrafluoride | — | 100 | — | — | — |
| C | polyimide | — | 50 | polyimide | carbon black | 5 |
| D | polyimide | — | 50 | — | — | — |
| E | polyamide-imide | — | 50 | polyimide | carbon black | 5 |
| F | polyamide- | — | 50 | — | — | — |

TABLE 1-continued

| Specimen | Charge carrier layer: Heat-resistant resin | Charge carrier layer: Photoconductive material | Charge carrier layer: Film thickness (μ) | Intermediate layer: Heat-resistant resin | Intermediate layer: Photoconductive material | Intermediate layer: Film thickness (μ) |
|---|---|---|---|---|---|---|
| | imide | | | | | |
| G | polyphenylene sulfite | — | 100 | polyimide | Al | 10 |
| H | polyphenylene sulfite | — | 100 | — | — | — |
| I | polyaryl sulfone | — | 100 | polyaryl sulfone | $SnO_2$ | 5 |
| J | polyethylene tetrafluoride | $TiO_2$ | 100 | — | — | — |
| K | polyimide | $Fe_2O_3$ | 50 | — | — | — |
| L | polyfluoroalkylene | — | 100 | polyimide | carbon black | 10 |
| M | polyethylene tetrafluoride | CdS | 35 | polyethylene tetrafluoride | carbon black | 10 |
| N | polyethylene tetrafluoride | CdS | 35 | — | — | — |
| O | polamide-imide | CdS | 25 | polyimide | carbon black | 5 |
| P | polyamide | ZnO | 25 | polyamide-imide | $SnO_2$ | 5 |

In the intermediate layer, the ratio of heat-resistant resin to carbon black is 5 to 1 (weight ratio) and the ratio of heat-resistant resin to aluminum (or $SnO_2$) is 5 to 3 (weight ratio). In the charge carrier layer, the ratio of heat-resistant resin to CdS, $TiO_2$ or $Fe_2O_3$ is 3.5 to 10 (weight ratio) and the ratio of heat-resistant resin to ZnO is 2 to 10 (weight ratio).

The charge carrier members of the present invention obtained as mentioned above were tested as mentioned in the following Experiments 1, 2 and 3. The results are shown in Table 2.

EXPERIMENT 1

Figure 5:
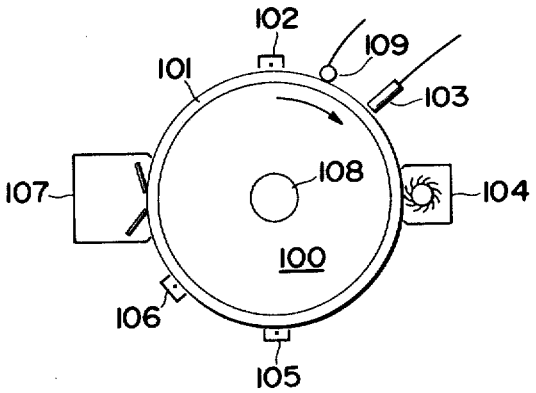
FIG. 5 is a diagram illustrating an apparatus employed in the first embodiment of the present invention.

FIG. 5 illustrates an apparatus for experiments, in which reference numeral 100 denotes a photosensitive drum on which is stretched a charge carrier member 101 shown in Table 1, 102 denotes a scorotron charger for uniformly charging the surface of the charge carrier member, 103 denotes a potential sensor for detecting the surface potential of the charge carrier member, 104 denotes a developing device for converting the electrostatic latent image on the surface of the charge carrier member into toner image, 105 denotes a d-c corona generator, 106 denotes an a-c corona generator, 107 denotes a cleaning device, 108 denotes a heater for heating the charge carrier member from the inner side, and 109 denotes a temperature sensor for detecting the temperature at the surface of the charge carrier member.

Using the above-mentioned apparatus, the photosensitive drum 100 was rotated at a speed of 25 rpm, while setting the developing device 104, cleaning device 107, d-c corona generator 105 and a-c corona generator 106 to be inoperative. Further, the surface of the photosensitive drum was maintained at 90° C. while monitoring it by the temperature sensor 109, the main voltage of the scorotron charger 102 was set at 7 KV and the grid voltage at 700 V to charge the surface of the charge carrier member. The potential at the surface was detected by the potential sensor 103. Then, after 5 minutes have passed, the potential at the surface was detected again by the potential sensor 103 to find dark attenuation factors. The results were as shown in Table 2.

$$\text{Dark attenuation factor} = \frac{\text{Initial potential} - \text{Potential after 5 min.}}{\text{Initial potential}} \times 100$$

As for the specimens A to L, the dark attenuation factors of smaller than 10 are evaluated to be small, dark attenuation factors of 10 to 30 are evaluated to be medium, and dark attenuation factors of larger than 30 are evaluated to be large. As for the specimens M to P, the dark attenuation factors of smaller than 20 are evaluated to be small, attenuation factors of 20 to 40 are evaluated to be medium, and attenuation factors of larger than 40 are evaluated to be large.

For the purpose of comparison, the following specimens were also employed.

| Specimen | Charge carrier layer |
|---|---|
| X | vinyl chloride/vinyl acetate copolymer |
| Y | vinyl chloride/vinyl acetate copolymer + CdS |

The ratio of copolymer to CdS in the specimen Y was 3.5 to 10 (weight ratio).

EXPERIMENT 2

Using the apparatus of FIG. 5, the charge carrier member was uniformly electrified by the scorotron charger 102. The image was then converted into a toner image by the developing device 10, and the homogeneity of the toner image was examined. The results are shown in Table 2.

EXPERIMENT 3

Using the apparatus of FIG. 5, the developing device 104 and the cleaning device 107 were set to be inoperative, and the charge carrier member was tested for durability through 10,000 times of operation while maintaining the temperature of 90° C. at the surface of the photosensitive drum 100. The potential retentivity was found from the initial dark potential and the dark potential after 10,000 times of operation. The results were as shown in Table 2.

$$\text{Potential retentivity} = \frac{\text{dark potential after 10,000 times of operation}}{\text{initial dark potential}} \times 100$$

As for the specimens A to L, the potential retentivities of greater than 90 are evaluated to be large, potential retentivities of 70 to 90 are evaluated to be medium, and potential retentivities of smaller than 70 are evaluated to be small. As for the specimens M to P, the potential retentivities of larger than 80 are evaluated to be large, potential retentivities of 60 to 80 are evaluated to be medium, and potential retentivities of smaller than 60 are evaluated to be small.

The comparative specimens were also evaluated in the same manner as the specimens M to P.

The results of Table 2 indicate that the charge carrier members of the present invention are excellent.

TABLE 2

| Specimen | Experiment 1 | Experiment 2 | Experiment 3 |
|---|---|---|---|
| A | small | good | large |
| B | small | white spots were developed | large |
| C | small | good | large |
| D | small | good | medium |
| E | small | good | large |
| F | small | white stripes were developed | medium |
| G | small | good | large |
| H | small | many white spots were developed | large |
| I | small | good | large |
| J | small | white spots were developed in small number | large |
| K | small | good | medium |
| L | small | good | large |
| M | small | good | large |
| N | medium | white spots were developed in many number | medium |
| O | small | good | large |
| P | medium | good | large |
| X | large | good | small |
| Y | large | many white spots were developed | small |

EXAMPLE 2

Using the apparatus of FIG. 2, the surface of the specimen M of Example 1 stretched on the charge carrier drum 10 was uniformly charged by the charger 12, and was exposed to the image-bearing light to obtain an electrostatic latent image. The electrostatic latent image was developed by the developing device 13 using a developing agent that will be mentioned below, and was transferred and fixed onto the transfer paper 15 at the transfer portion A.

The developing agent was the two-component one consisting of 5 parts by weight of the toner mentioned below and 95 parts by weight of a carrier of iron powder.

| | |
|---|---|
| **Toner (a)** | |
| Styrene resin | 100 parts by weight |
| Carbon black | 5 parts by weight |
| Low molecular weight polypropylene [Viscol 660P, a product of Sanyo Kasei Co.] | 5 parts by weight |
| **Toner (b)** | |
| Epoxy resin | 100 parts by weight |
| Carbon black | 5 parts by weight |

Each of the above toners was mixed with the carrier, melted, kneaded, cooled and pulverized.

The developing agent employing the toner (a) made it possible to continuously obtain five copies maintaining good picture quality. The developing agent employing the toner (b), however, caused the transfer paper to be wound on the charge carrier drum, and further caused the images of the second and subsequent copies to be slightly contaminated.

EXAMPLE 3

Using the apparatus of FIG. 3, the electrostatic latent image was formed on the surface of the specimen C of Example 1 that was stretched along the charge carrier drum 10, by using an electrostatic recording needle.

The electrostatic latent image was developed by the developing device 13 using the same developing agents as those used in Example 2, transferred onto the sticky transfer belt 23 at the transfer portion A, and was further fixed by melting on the transfer paper 15 at the fixing portion B.

The picture obtained by using the toner (a) maintained good quality even when copies were obtained continuously. However, the picture on the second and subsequent copies obtained by using the toner (b) was contaminated due to the offset phenomenon.

What is claimed is:

1. A charge carrier member comprising an intermediate layer which is formed on a support member, the intermediate layer being composed of a heat-resistant first resin containing electrically conductive material, and a charge carrier layer composed of a heat-resistant second resin formed on the intermediate layer and wherein said first resin is selected from a fluorine-containing resin, a polyimide resin, a polyimide-amide resin, a polyarylsulfone resin and a polyphenylene sulfite resin and wherein said second resin is selected from the group consisting of said first resin and polyamide.

2. A charge carrier member according to claim 1, wherein the electrically conductive material is carbon black.

3. A charge carrier member according to claim 1, wherein the support member is an electrically conductive support member.

4. A charge carrier member according to claim 3, wherein the electrically conductive support member consists of an electrically conductive member which is provided on an insulating member.

5. A charge carrier member according to claim 4, wherein the electrically conductive member is aluminum.

6. A charge carrier member according to claim 5, wherein the surface of aluminum is treated with boehmite.

7. A charge carrier member according to claim 1, wherein the charge carrier layer further contains a photoconductive material.

8. A charge carrier member according to claim 7, wherein the photoconductive material is an inorganic photoconductive material.

9. A charge carrier member according to claim 7 or 8, wherein the photoconductive material is CdS, CdSSe, CdSe, ZnSe, ZnCdS, $TiO_2$, ZnO or $CdS.CdCO_3$.

10. A charge carrier member comprising an intermediate layer which is formed on a support member, the intermediate layer being composed of a heat-resistant first resin containing electrically conductive material, and a charge carrier layer composed of a heat-resistant second resin formed on the intermediate layer and wherein said second resin is selected from a fluorine-containing resin, a polyimide resin, a polyimide-amide resin, a polyarylsulfone resin, a polyamide resin and a polyphenylene sulfite resin and wherein said first resin is a polyamide resin.

11. The charge carrier member of claim 1 or 10 wherein said intermediate layer is at least 5μ thick.

12. A method of forming a copy image which comprises forming an electrostatic latent image on the charge carrier member of claim 1, converting the electrostatic latent image into a toner image using a developing agent, and transferring the toner image onto a transfer medium.

13. A method of forming a copy image according to claim 12, wherein the heat-resistant resin is a fluorine-containing resin, a polyimide resin, a polyamide resin, a polyimideamide resin, a polyarylsulfone resin or a polyphenylene sulfite resin.

14. A method of forming a copy image according to claim 12, wherein the electrically conductive material is carbon black.

15. A method of forming a copy image according to claim 12, wherein the support member is an electrically conductive support member.

16. A method of forming a copy image according to claim 12, wherein the charge carrier layer further contains a photoconductive material.

17. A method of forming a copy image according to claim 16, wherein the photoconductive material is an inorganic photoconductive material.

18. A method of forming a copy image according to claim 16 or 17, wherein the photoconductive material is CdS, CdSSe, CdSe, ZnSe, ZnCdS, $TiO_2$, ZnO or $CdS.CdCO_3$.

19. A method of forming a copy image according to claim 12, wherein the surface of the charge carrier member is uniformly charged prior to forming the electrostatic latent image.

20. A method of forming a copy image according to claim 12, wherein the developing agent is a one-component-type developing agent without containing a carrier.

21. A method of forming a copy image according to claim 20, wherein the developing agent has electrical conductivity.

22. A method of forming a copy image according to claim 12, 20 or 21, wherein the developing agent has a parting property.

23. A method of forming a copy image according to claim 12, 20, or 21, wherein the developing agent contains a styrene-type polymer.

24. A method of forming a copy image according to claim 12, wherein the transfer is a tacky image transfer.

25. A method of forming a copy image according to claim 12, wherein the transfer is to transfer and fix the image.

26. A method of forming copy image according to claim 12, wherein the transfer medium is a tacky transfer medium.

27. A method of forming a copy image according to claim 22 wherein the developing agent contains a styrene-type polymer.

28. A method of forming a copy image comprising forming an electrostatic latent image on the charge carrier member of claim 10, converting said electrostatic latent image into a toner image using a developing agent and transferring said toner image onto a transfer medium.

* * * * *